US010194782B2

(12) United States Patent
Pers et al.

(10) Patent No.: US 10,194,782 B2
(45) Date of Patent: Feb. 5, 2019

(54) DISHWASHER COMPRISING A SPRAY ARM ARRANGEMENT

(71) Applicant: ELECTROLUX APPLIANCES AKTIEBOLAG, Stockholm (SE)

(72) Inventors: Per-Erik Pers, Stockholm (SE); Elianne Lindmark, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 60 days.

(21) Appl. No.: 15/531,607

(22) PCT Filed: Dec. 18, 2014

(86) PCT No.: PCT/EP2014/078527
§ 371 (c)(1),
(2) Date: May 30, 2017

(87) PCT Pub. No.: WO2016/096019
PCT Pub. Date: Jun. 23, 2016

(65) Prior Publication Data

US 2017/0332877 A1 Nov. 23, 2017

(51) Int. Cl.
*A47L 15/23* (2006.01)
*A47L 15/00* (2006.01)
(Continued)

(52) U.S. Cl.
CPC ..... *A47L 15/23* (2013.01); *A47L 15/0047* (2013.01); *A47L 15/0049* (2013.01); *A47L 15/22* (2013.01);
(Continued)

(58) Field of Classification Search
None
See application file for complete search history.

(56) References Cited

U.S. PATENT DOCUMENTS

2004/0173249 A1* 9/2004 Assmann ..... A47L 15/4221 134/94.1
2013/0319482 A1* 12/2013 Vallejo Noriega ..... A47L 15/4285 134/99.1
2015/0230687 A1* 8/2015 Dries ..... A47L 15/4221 134/200

FOREIGN PATENT DOCUMENTS

DE 4020898 1/1992
DE 10 2006 007325 8/2007
(Continued)

OTHER PUBLICATIONS

International Search Report and Written Opinion for corresponding International Application No. PCT/EP2014/078527, dated Sep. 21, 2015.

*Primary Examiner* — Jason Y Ko
(74) *Attorney, Agent, or Firm* — Alston & Bird LLP

(57) ABSTRACT

A dishwasher may include a spray arm arrangement and a washing chamber. The spray arm arrangement may include a spray arm arranged to rotate around a first axis of rotation within said washing chamber. The spray arm may be provided with one or more spray nozzles arranged to spray washing liquid into said washing chamber. The dishwasher may also include a mechanical switch for detecting an angular position of said spray arm. The spray arm arrangement may further include an activating device arranged to rotate with said spray arm, which activating device may include at least one activating structure arranged to cyclically activate said mechanical switch during rotation of said spray arm.

8 Claims, 2 Drawing Sheets

(51) Int. Cl.

| | |
|---|---|
| ***A47L 15/22*** | (2006.01) |
| ***A47L 15/42*** | (2006.01) |
| ***A47L 15/46*** | (2006.01) |

(52) U.S. Cl.

CPC ..... *A47L 15/4289* (2013.01); *A47L 15/46* (2013.01); *A47L 2401/24* (2013.01); *A47L 2501/04* (2013.01); *A47L 2501/20* (2013.01); *A47L 2501/30* (2013.01)

(56) References Cited

FOREIGN PATENT DOCUMENTS

| | | |
|---|---|---|
| EP | 0 962 181 | 12/1999 |
| EP | 1 238 622 | 9/2002 |

* cited by examiner

DISHWASHER COMPRISING A SPRAY ARM ARRANGEMENT

CROSS-REFERENCE TO RELATED APPLICATIONS

This application is a national stage application filed under 35 U.S.C. § 371 of International Application No. PCT/EP2014/078527 filed Dec. 18, 2014, which is hereby incorporated by reference in its entirety.

TECHNICAL FIELD

The present invention relates to a dishwasher comprising a spray arm arrangement.

BACKGROUND

Today's dishwashers are expected to perform high quality wash of items. Further, environmental concerns require an efficient use of water and energy during a wash cycle. The requirement of performing high quality wash of items and the requirement of efficient use of water and energy during a wash cycle puts requirements on spray arm arrangements for dishwashers. A spray arm comprising spray nozzles is usually rotatably arranged inside a washing chamber of a dishwasher to distribute a washing liquid, such as water and detergent, on to items in the dishwasher. The spray arm may be driven to rotate by the force of cleaning sprays from the spray nozzles. The spray arm may also comprise a dedicated drive nozzle adapted to create a driving force on the spray arm. During rotation of the spray arm within the washing chamber, the water and detergent is distributed on to the items with a pressure adapted not to harm glass or other delicate items. However, a limitation in spray pressure may lead to heavily soiled items like pots and pans not being properly cleaned. These items may thus require a second washing procedure to be sufficiently cleaned, leading to unnecessary waste of water. Further, items located in the dishwasher, such as cutlery, may block the rotation of the spray arm. A blocked spray arm will only distribute washing liquid over a limited region of the dishwasher, thereby wasting water and energy without performing washing action as intended.

Document DE 4020898 A1 describes a method of detecting a blocked spray arm using a rotation detecting sensor. The sensor provides a pulse signal every time the spray arm passes the sensor, which pulse signal restarts a countdown. If the spray arm is blocked the sensor will not provide the pulse signal and the countdown will not be restarted. When the countdown ends, the washing procedure will be ended in order to save washing fluid and reduce the risk of damaging the dishwasher. In one embodiment, the sensor comprises a deflecting wall, such as an elastic rubber membrane, arranged in a spray area of the cleaning spray from a spray nozzle. When the spray arm passes the deflecting wall the force of the spray causes the deflecting wall to deflect which causes the deflecting wall to activate a micro switch arranged in contact with the deflecting wall.

Thus, the method described in document DE 4020898 A1 requires modifications of the wall within the washing chamber and the use of a deflecting wall. Also, monitoring of rotation of the spray arm may be imprecise since the method is dependent on a spray hitting the deflecting wall. For example, if a spray nozzle is clogged, the spray may not reach the deflecting wall. In such case the method will not detect rotation of the spray arm, even though the spray arm may still rotate. Also, several neighbouring spray nozzles hitting the deflector wall may lead to an imprecise monitoring of rotation of the spray arm. Further, the deflector wall as described in DE 4020898 A1 may be sensitive to damages.

In view of the above, there is room for improvement of dishwashers comprising a spray arm arrangement.

SUMMARY

An object of the present invention is to provide a dishwasher with an improved spray arm arrangement.

According to an aspect of the invention, the object is achieved by a dishwasher comprising a spray arm arrangement and a washing chamber, the spray arm arrangement comprising:

- a spray arm arranged to rotate around a first axis of rotation within the washing chamber, the spray arm being provided with at least one spray nozzle arranged to spray washing liquid into the washing chamber, and
- a mechanical switch, for detecting an angular position of the spray arm, and wherein the spray arm arrangement further comprises an activating device arranged to rotate with the spray arm, and wherein the activating device comprises at least one activating structure arranged to cyclically activate the mechanical switch during rotation of the spray arm.

Since the activating device comprises at least a first activating structure arranged to cyclically activate the mechanical switch during rotation of the spray arm, the mechanical switch is activated in a controlled, reproducible, and predictable manner. Thereby, rotation of the spray arm, as well as an angular position of the spray arm can be detected in a controlled, reproducible, and predictable manner using the mechanical switch.

Furthermore, since the angular position of the spray arm can be detected when the at least first activating structure of the activating device passes the mechanical switch, the rotational speed of the spray arm may be calculated using a time it takes for the spray arm to move between two known angular positions of the spray arm. Knowing the rotational speed of the spray arm, a current rotational position of the spray arm may be estimated based on the last known position and the rotational speed. The estimated current position of the spray arm may be used to adapt the cleaning intensity to different conditions in different areas of the washing chamber. The cleaning intensity may be adapted by changing the pressure of the cleaning sprays in different areas of the washing chamber, such as increasing the pressure in areas were heavily soiled items are placed and reducing the pressure in areas were delicate items such as glasses are placed.

Due to these features, an improved dishwasher is provided. As a result, the above mentioned object is achieved.

According to some embodiments, the activating device further comprises at least a second activating structure, wherein the at least second activating structure is arranged to activate the mechanical switch at an angular position of the spray arm different from an angular position of the spray arm in which the at least first activating structure is arranged to activate the mechanical switch. Thereby, a more precise determination of the position of the spray arm can be achieved since also the second activating structure will activate the mechanical switch. Also, a more precise control of the pressure of the cleaning sprays can be achieved. The precision of the detection of the angular position may further be increased by providing an activating device comprising three or more activating structures, each being arranged to cyclically activate the mechanical switch during rotation of the spray arm.

According to some embodiments, a length of the at least first activating structure is different from a length of the at least second activating structure, such that the at least first activating structure is arranged to activate the mechanical switch for a different amount of time than the at least second activating structure. Thereby, a specific length of the period in which the mechanical switch is activated corresponds to a specific position of the spray arm. Thereby, the precision of the detection of the angular position may further be increased by detecting the period in which the mechanical switch is activated.

According to some embodiments, the at least first activating structure comprises a protrusion extending radially from the activating device with regard to an axis of rotation of the activating device. A radially extending activating structure allows the activating device to be compact in an axial direction, which may reduce required clearance for mounting the activating device in the dishwasher.

According to further embodiments, the at least first activating structure comprises a protrusion extending axially from the activating device with regard to an axis of rotation of the activating device.

According to some embodiments, the activating device is arranged on the spray arm, such that an axis of rotation of the activating device coincides with the first axis of rotation. By arranging the activating device on the spray arm, a compact spray arm arrangement is provided.

According to some embodiments, the rotation of the spray arm is arranged to be driven by a force of the spray of washing liquid from the at least one spray nozzle. Thereby, a cost efficient and reliable spray arm arrangement is achieved, since the number of moving parts in the arrangement can be kept at a minimum level.

According to some embodiments, the dishwasher further comprises a motor arranged to rotate the spray arm. Since a motor is arranged to rotate the spray arm instead of, or in addition to, the force of the spray nozzles, a larger proportion of the force of the sprays can be used for cleaning purposes. Furthermore, since the positioning of the spray arm and the cleaning force of the spray nozzles are separated from each other the cleaning force may be adapted independently from the position of the spray arm. Thereby, an even further improved dishwasher is provided.

Further features of, and advantages with, the present invention will become apparent when studying the appended claims and the following detailed description. Those skilled in the art will realize that the different features described may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The embodiments herein will now be described more fully with reference to the accompanying drawings. Like numbers refer to like elements throughout.

Figure 1:
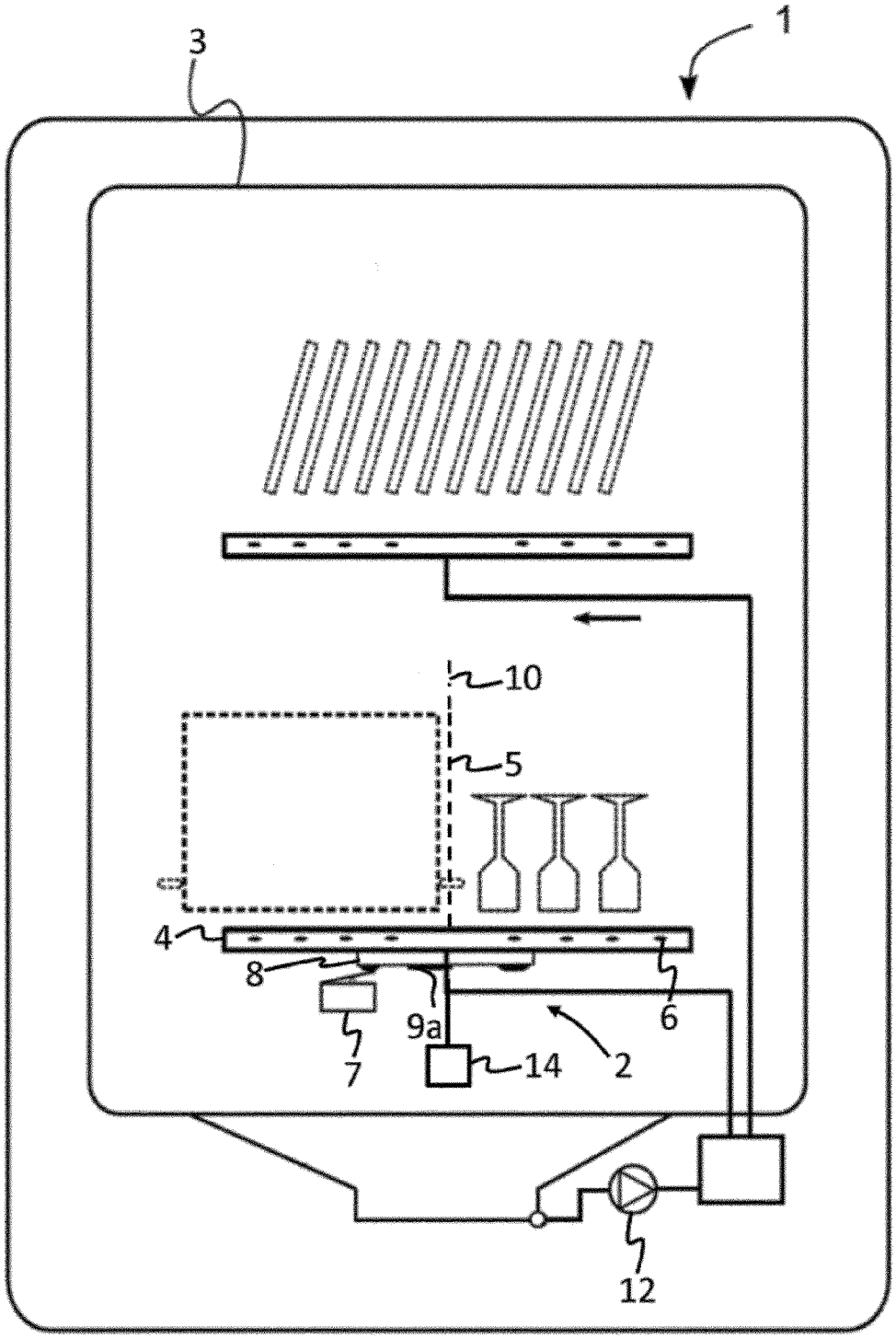
FIG. 1 illustrates a dishwasher with a wash arm arrangement according to some embodiments.

FIG. 1 illustrates a dishwasher 1 according to some embodiments. The dishwasher 1 comprises a spray arm arrangement 2 and a washing chamber 3 for receiving items to be washed.

The spray arm arrangement 2 is arranged inside the washing chamber 3 and comprises a spray arm 4 arranged to rotate around a first axis of rotation 5. The spray arm 4 may be provided with one or more spray nozzles 6. The spray arm 4 may comprise a hollow body connected to a washing liquid supply, such as a washing liquid pump 12. The hollow body of the spray arm 4 may further be in communication with the one or more spray nozzles 6 of the spray arm 4. Thereby, washing liquid may be pumped from the washing liquid supply into the spray arm 4 and out into the washing chamber 3 of the dishwasher via the one or more spray nozzles 6. The spray arm 4 may in some embodiments comprise one or more spray nozzles 6 being inclined in the sense that washing liquid being evacuated through the spray nozzle is evacuated in a direction opposite to an intended direction of rotation of the spray arm 4. Thereby, washing liquid evacuated via the spray nozzles 6 will create a reaction force applying a torque onto the spray arm 4 which may cause the spray arm 4 to rotate around the first axis of rotation 5.

The spray arm arrangement 2 further comprises a mechanical switch 7, such as a mechanic micro switch, for detecting an angular position of the spray arm 4. The mechanical switch 7 may be non-rotatably arranged to the dishwasher 1. The spray arm arrangement 2 further comprises an activating device 8 arranged to rotate with the spray arm 4, which activating device 8 comprises at least a first activating structure 9*a* arranged to cyclically activate the mechanical switch 7 during rotation of the spray arm 4. The switch 7 comprises a switch body, which switch body abuts the activating device 8. When the at least first activating structure 9*a* passes the switch body of the switch 7, the switch body changes position thereby activating the switch 7. Since the at least first activating structure 9*a* cyclically activates the mechanical switch 7, a rotational position of the spray arm 4, predefined by the position of the at least first activating structure 9*a*, can be detected during rotation of the spray arm 4. By detecting the rotation of the spray arm 4 a blockage of the spray arm 4 may be detected. The dishwasher 1 may further comprise a control unit (not shown) adapted to detect rotation of the spray arm 4 and/or an angular position of the spray arm 4 on the basis of the activation of the mechanical switch 7 by the at least first activating structure 9*a*. The control unit may further be adapted to calculate a rotational speed of the spray arm 4, based on the distance the activating structure 9 travels and the time it takes between two activations of the mechanical switch 7. The control unit may further be adapted to determine the current rotational position of the spray arm 4 based on the known position of the at least first activating structure 9*a* and the calculated rotational speed. By determining the current rotational position of the spray arm 4, the cleaning intensity of the sprays may be adapted to different cleaning conditions in different areas of the washing chamber 3.

As illustrated in FIG. 1 the washing chamber 3 may comprise heavily soiled items, such as pots or pans, as well as delicate items, such as glasses. The control unit may further be adapted to increase the cleaning intensity of the sprays in parts of a swept area of the spray arm where the heavily soiled items are placed and to reduce the cleaning intensity in parts of the swept area where the delicate items are placed, based on the detected position of the spray arm. Thereby maximum cleaning power may be applied on the heavily soiled items while a reduced power is applied on the delicate items. As a result, duration of the washing cycle may be reduced, thereby saving water and energy, whilst increasing the cleaning efficiency of the washing cycle.

In some embodiments, since an angular position of the spray arm 4 is detected, the control unit may further be adapted to switch of the sprays from the spray nozzles 6 in parts of the swept area of the spray arm 4 where no items are placed. This will further reduce the water consumption during the washing cycle.

Since the spray arm arrangement 2 comprises the activating device 8 arranged to rotate with the spray arm 4, the mechanical switch 7 does not have to be placed in connection to the spray arm 4. Instead, the mechanical switch 7 may be spaced away from the spray arm 4 to a location where it is less exposed to the spray from the nozzles. In embodiments herein, the activating device 8 may be arranged outside the washing chamber 3. In such embodiments the activating device 8 may be fixedly attached to a shaft, which shaft may be fixedly attached to the spray arm 4 at the spray arms 4 axis of rotation 5, such that the activating device 8 rotates with the spray arm 4.

According to some embodiments herein, the activating device 8 may comprise at least a first activating structure 9*a* and at least a second activating structure 9*b*. The at least first activating structure 9*a* may be arranged to activate the mechanical switch 7 at an angular position of the spray arm 4 different from an angular position of the spray arm 4 in which the at least second activating structure 9*b* is arranged to activate the mechanical switch 7. Thereby, a more precise determination of the position of the spray arm 4 can be achieved since also the second activating structure 9*b* will activate the mechanical switch 7. Hence, a more precise control of the pressure of the cleaning sprays can be achieved. The precision of the detection of the angular position of the spray arm 4 may further be increased by providing an activating device comprising three or more activating structures 9, each being arranged to cyclically activate the mechanical switch 7 during rotation of the spray arm 4. The at least first activating structure 9*a* may be arranged on the activating device 8 at a different angular position than the at least one second activating structure 9*b*, such that the first and second activating structures 9*a*, 9*b* are arranged at an angle to each other with regard to an axis of rotation 10 of the activating device 8. In some embodiments herein, the angle between the at least first 9*a* and the at least second activating structure 9*b* is more than 0° but less than 180°, such that a rotational distance, i.e. the distance around a circumference of the activating device 8, between the at least first activating structure 9*a* and the at least second activating structure 9*b* is different than the rotational distance between the second activating structure 9*b* and the first activating structure 9*a*, during a complete rotation of the activating device 8.

According to some embodiments however, the activating device 8 comprises at least three activating structures 9*a*, 9*b* and 9*c*, each being arranged at an angle to each other with regard to the axis of rotation 10 of the activating device 8. The at least three activating structures 9*a*, 9*b* and 9*c* are arranged in such that at least three of the angles between each activating structure 9*a*, 9*b* and 9*c* are different from each other. The control unit may further be adapted to determine the direction of rotation of the spray arm 4, since the sequence of angles, and thereby the sequence of rotational distances between the activating structures 9, will be different when the spray arm 4 rotates in a clockwise direction compared to a counter clockwise direction.

According to some further embodiments herein, a length of the at least first activating structure 9*a* is different from a length of the at least second activating structure 9*b*, such that the at least first activating structure 9*a* is arranged to activate the mechanical switch 7 for a different amount of time than the at least second activating structure 9*b*. Thereby, a specific length of the period which the mechanical switch 7 is activated corresponds to a specific position of the spray arm, such that a specific signal pattern is created when the activating device 8 rotates. Thus, the control unit may be adapted to detect the direction of rotation of the spray arm 4, since the signal pattern will differ depending on the direction of rotation of the activating device 8 and hence of the spray arm 4.

According to some embodiments, the activating structures 9 are of the same length but are placed in groups, such that each group comprises a different number of activating structures 9. The activating structures 9 of each group are arranged at the same radius from the axis of rotation 10 of the activating device 8. For example, the second activating structure 9*b* may be replaced by a group of two activating structures 9 and a third activating structure may be replaced by a group of three activating structures 9. Each group of activating structures 9 may be arranged at a longer rotational distance from each other than the activating structures 9 in each individual group.

The activating structures 9, 9*a*-9*c* described herein may each comprise an portion of the activating device 8 which causes the mechanical switch 7 to change position when the activating structure 9, 9*a*-9*c* passes the switch 7, and may comprise a protrusion, a recess or a hole or the like. When the activating structure 9, 9*a*-9*c* comprises a protrusion, the switch 7 is activated by the protrusion creating a force acting on the switch when the protrusion passes the switch 7. In embodiments where the activating structure 9, 9*a*-9*c* comprises a recess or a hole, the switch body is biased towards the activating device 8. When the recess or the hole passes the switch body of the switch 7, the biasing force causes the switch body to change position.

Figure 2:
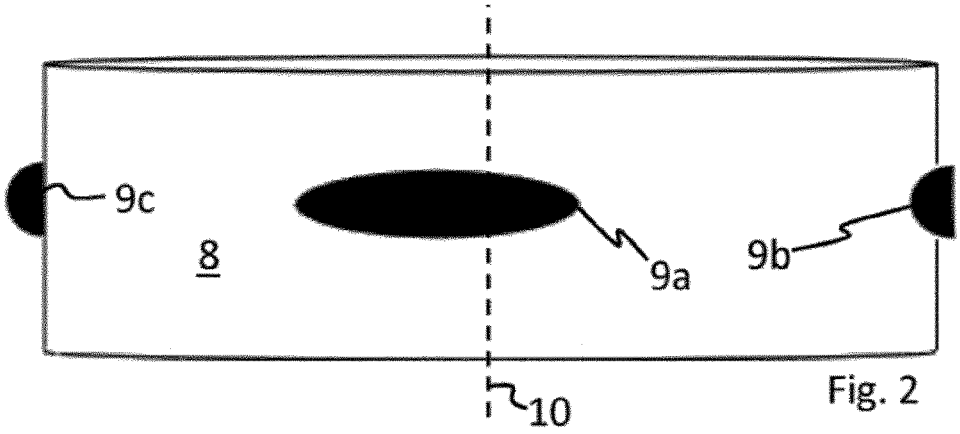
FIG. 2 shows an activating device according to some embodiments illustrated in a plane parallel to the axis of rotation of the activating device.

FIG. 2 illustrates an activating device according to some embodiments herein. The activating device 8 comprises at least a first activating structure 9*a* extending radially from the activating device 8 with regard to an axis of rotation 10 of the activating device 8. The activating device 8 is shown viewed from a plane parallel to the axis of rotation 10 of the activating device 8. The activating device 8 may e.g. be formed as a cylindrical body, wherein the at least one activating structure 9 may be arranged around a circumference of the circular body. In the embodiments shown in FIG. 2, the activating structure 9 is a protrusion and extending in a plane perpendicular to the axis of rotation 10 of the activating device 8. The switch body of the mechanical switch 7 abuts the circumference of the activating device 8 during rotation of the activating device 8. Since the radius of the circumference of the activating device 8 increases over the at least first activating structure 9*a*, the switch body of the mechanical switch will change position when the at least first activating structure 9*a* passes the switch 7. The activating device 8 further comprises a second activating structure 9*b* and a third activating structure 9*c*, which also extend radially from the activating device 8 with regard to an axis of rotation 10 of the activating device 8. The length of the at least first activating structure 9*a* along the circumference of the activating device 8, may be different from a length of the second activating structure 9*b* and the third activating structure 9*c*, which creates a pulse pattern depending on the rotational position of the activating device 8. Such pulse pattern can be monitored by the control unit to determine a rotational direction of the spray arm. By placing the activating structures 9 on the circumference of the activating device 8, the length of the activating device 8 in axial direction may be reduced since only the length and the height of the activating structure 9, i.e. the outer radius of the activating device 8 is relevant for the activation of the switch 7. Thereby the required clearance for mounting the activating device 8 in the dishwasher 1 may be reduced.

Figure 3A:
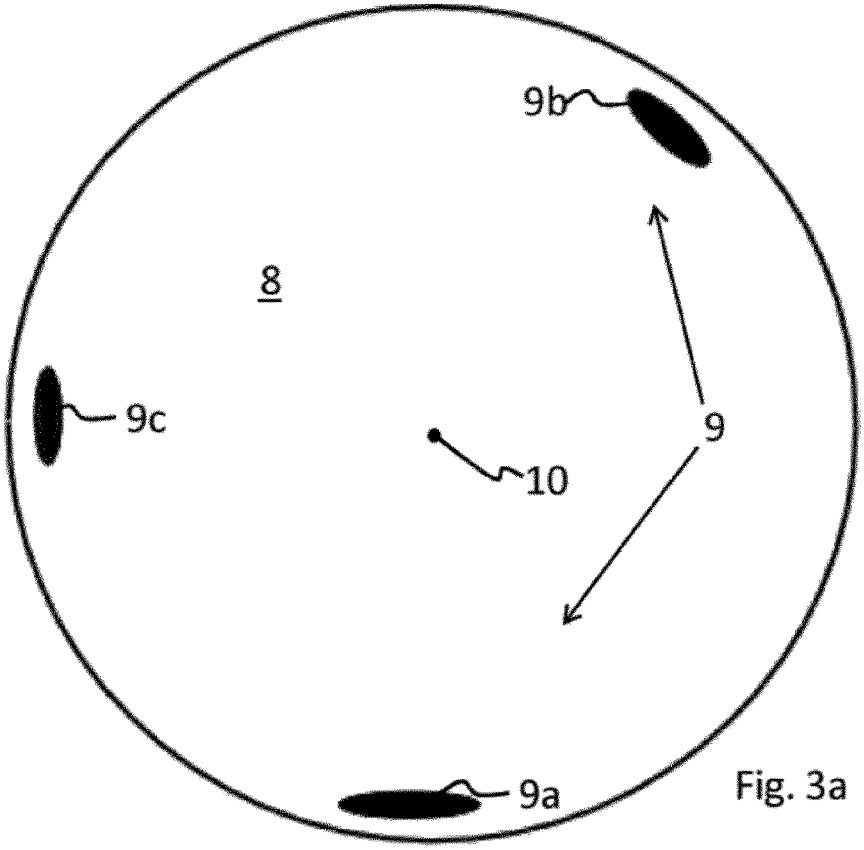
FIG. 3*a* shows an activating device according to some embodiments illustrated in a plane perpendicular to the axis of rotation of the activating device.
Figure 3B:
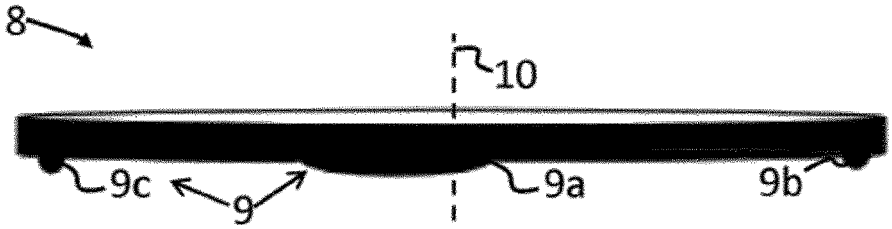
FIG. 3*b* shows an activating device according to some embodiments in a plane parallel to the axis of rotation of the activating device.

FIG. 3*a* illustrates an activating device 8 according to some embodiments. FIG. 3*a* shows the activating device 8 illustrated in a plane perpendicular to the axis of rotation 10 of the activating device 8 and FIG. 3*b* shows the activating device 8 illustrated in a plane parallel to the axis of rotation 10. The activating structures 9, 9*a*-9*c* extend axially from the activating device 8 with regard to an axis of rotation 10 of the activating device 8. The activating device 8 is formed as a circular body with the at least one activating structure 9 being arranged around the circumference of the body at a radius from the rotational axis of the body. The activating device may however also be formed as a partially circular body. The circular body extends in a plane perpendicular to the axis of rotation 10 of the activating device 8. The at least one activating structure 9 is arranged at the circumference of the circular body and extending in a plane perpendicular to the circular body. In the illustrated embodiment the activating device 8 comprises three activating structures 9*a*, 9*b* and 9*c*, wherein the first activating structure 9*a* has a different length than the at least one second activating structure 9*b* and the at least one third activating structure 9*c*. The three activating structures 9 are further arranged such that the rotational distances, i.e. the rotational angles, between the activating structures 9*a*, 9*b* and 9*c* each are different from each other. Thereby, the direction of rotation of the spray arm 4 may be determined since the sequence of rotational angles, and thereby the sequence of rotational distances between the activating structures 9, will be different when the spray arm 4 rotates in a clockwise direction compared to a counter clockwise direction.

In some embodiments, the activating device 8 is arranged on the spray arm 4, such that an axis of rotation 10 of the activating device 8 coincides with the first axis of rotation 5.

In some embodiments, the dishwasher 1 comprises a motor, such as an electric motor, arranged to rotate the spray arm 4. Since the rotation of the spray arm 4 is driven by the motor instead of, or in addition to, the sprays from the spray nozzles 6, a larger proportion of the force of the sprays can be used for cleaning purposes. Furthermore, since the positioning of the spray arm 4 and the cleaning force of the sprays from the spray nozzles 6 may be separated from each other, the cleaning force may be adapted independently from the position of the spray arm 4. For example, the control unit may be adapted to reduce the rotational velocity and/or increase the spray pressure when the spray arm 4 passes areas of the dishwasher 1 comprising heavily soiled items. The control unit may further be adapted to increase the rotational velocity and/or reduce the spray pressure, when the spray arm 4 passes areas comprising delicate items. Thereby, a spray arm arrangement 2 is provided which further improves the cleaning performance of the dishwasher 1.

The dishwasher 1 provided may comprise two or more spray arm arrangements 2, as illustrated in FIG. 1.

It is to be understood that the foregoing is illustrative of various examples and the present disclosure is not to be limited to the specific varieties disclosed and that modifications to the disclosed examples, combinations of features of disclosed examples as well as other varieties are intended to be included within the scope of the appended claims.

The invention claimed is:

1. A dishwasher comprising a spray arm arrangement and a washing chamber, said spray arm arrangement comprising:

a spray arm arranged to rotate around a first axis of rotation within said washing chamber, said spray arm being provided with at least one spray nozzle arranged to spray washing liquid into said washing chamber, and a mechanical switch, for detecting an angular position of said spray arm, wherein said spray arm arrangement further comprises an activating device arranged to rotate with said spray arm, and wherein said activating device comprises at least a first activating structure arranged to cyclically activate said mechanical switch during rotation of said spray arm.

2. The dishwasher according to claim 1, wherein said activating device further comprises at least a second activating structure, wherein said at least second activating structure is arranged to activate said mechanical switch at an angular position of said spray arm different from an angular position of said spray arm in which said at least first activating structure is arranged to activate said mechanical switch.

3. The dishwasher according to claim 2, wherein a length of said at least first activating structure is different from a length of said at least second activating structure, such that said at least first activating structure is arranged to activate said mechanical switch for a different amount of time than said at least second activating structure.

4. The dishwasher according to claim 1, wherein said at least first activating structure comprises a protrusion extending radially from said activating device with regard to an axis of rotation of said activating device.

5. The dishwasher according to claim 1, wherein at least said first activating structure comprises a protrusion extending axially from said activating device with regard to an axis of rotation of said activating device.

6. The dishwasher according to claim 1, wherein said activating device is arranged on said spray arm, such that an axis of rotation of said activating device coincides with said first axis of rotation.

7. The dishwasher according to claim 1, wherein said rotation of said spray arm is arranged to be driven by a force of the spray of washing liquid from said at least one spray nozzle.

8. The dishwasher according to claim 1, further comprising a motor arranged to rotate said spray arm.

* * * * *